United States Patent [19]

Ruger

[11] 4,429,617

[45] Feb. 7, 1984

[54] RECIPROCATING SLIDE DAMPENING MECHANISM FOR FIREARMS

[75] Inventor: William B. Ruger, Southport, Conn.

[73] Assignee: Sturm, Ruger & Company, Inc., Southport, Conn.

[21] Appl. No.: 314,458

[22] Filed: Oct. 23, 1981

[51] Int. Cl.[3] ..... F41C 27/00

[52] U.S. Cl. ..... 89/198

[58] Field of Search ..... 89/191 R, 191 A, 196, 89/198

[56] References Cited

U.S. PATENT DOCUMENTS 3,240,121 3/1983 Sefried .
3,241,449 3/1966 Dwyer ..... 89/196
3,857,323 12/1974 Ruger et al. .

*Primary Examiner*—Stephen C. Bentley
*Attorney, Agent, or Firm*—Pennie & Edmonds

[57] ABSTRACT

A firearm slide dampening system in which the slide is associated with a rod. The slide moves rearwardly during recoil until it engages a novel floatingly mounted socket on a transverse axle. The rearward end of the rod carries a novel spring-biased head slanted and shaped to the slidably engage the socket to absorb energy the socket receives from the slide.

4 Claims, 4 Drawing Figures

RECIPROCATING SLIDE DAMPENING MECHANISM FOR FIREARMS

DESCRIPTION

1. Technical Field

This invention relates to firearms with reciprocating slides for loading and unloading the firearm and, in particular, to gas operated auto-loading rifles in which the recoil of the reciprocating slide mechanism causes shock and vibration to the firearm during the firing cycle.

2. Background Art

Numerous arrangements have been suggested for decelerating and stopping the slide mechanism on a firearm during its rearward movement. Guide rods, springs and receiver stop means provide an arrangement for arresting the slide after its initial acceleration by gases diverted from the barrel as shown in U.S. Pat. No. 3,857,323 to Ruger.

It has also been suggested to use cam surfaces to decelerate breechlocks in guns as shown in U.S. Pat. No. 3,240,121 to Sefried.

The present arrangement provides a compact novel slide dampening arrangement utilizing in part the resilience of the rod slide spring employed to return the slide to its foreward rest position. This is particularly useful in auto-loading firearms having telescopic sights mounted thereon, since the shock delivered to these relatively fragile mechanisms is greatly reduced by this invention. However, it is useful in all auto-loading firearms to decrease the shock, vibration, and strain to parts heretofore considered normal in such reciprocating mechanisms.

SUMMARY OF THE INVENTION

Broadly, the present invention comprises a slide dampening mechanism including a rod and a return spring positioned forward of the receiver for dampening the vibrations and shock caused by the slide engaging the receiver during its recoil (rearward slide). The mechanism is a recessed socket block mounted for limited movement in the firearm which block is moved to the rear when the slide engages the block. The rod end is positioned between the block and block mount to cause the rod to move forwardly against the return spring as the socket block is moved rearwardly.

It is a feature of the invention that the recoiling slide travel is arrested without the use of additional resilient parts, such as rubber, plastic or other compressible materials which are subject to deterioration from solvents, age and other causes. All parts of the present, not employed in prior rifles, are formed of metal for long life without deterioration.

Another significant feature is that the shock-absorbing mechanism functions in a very short length of cycling while still providing the accessory cushioning effect.

DESCRIPTION OF THE PREFERRED EMBODIMENT

Figure 1:
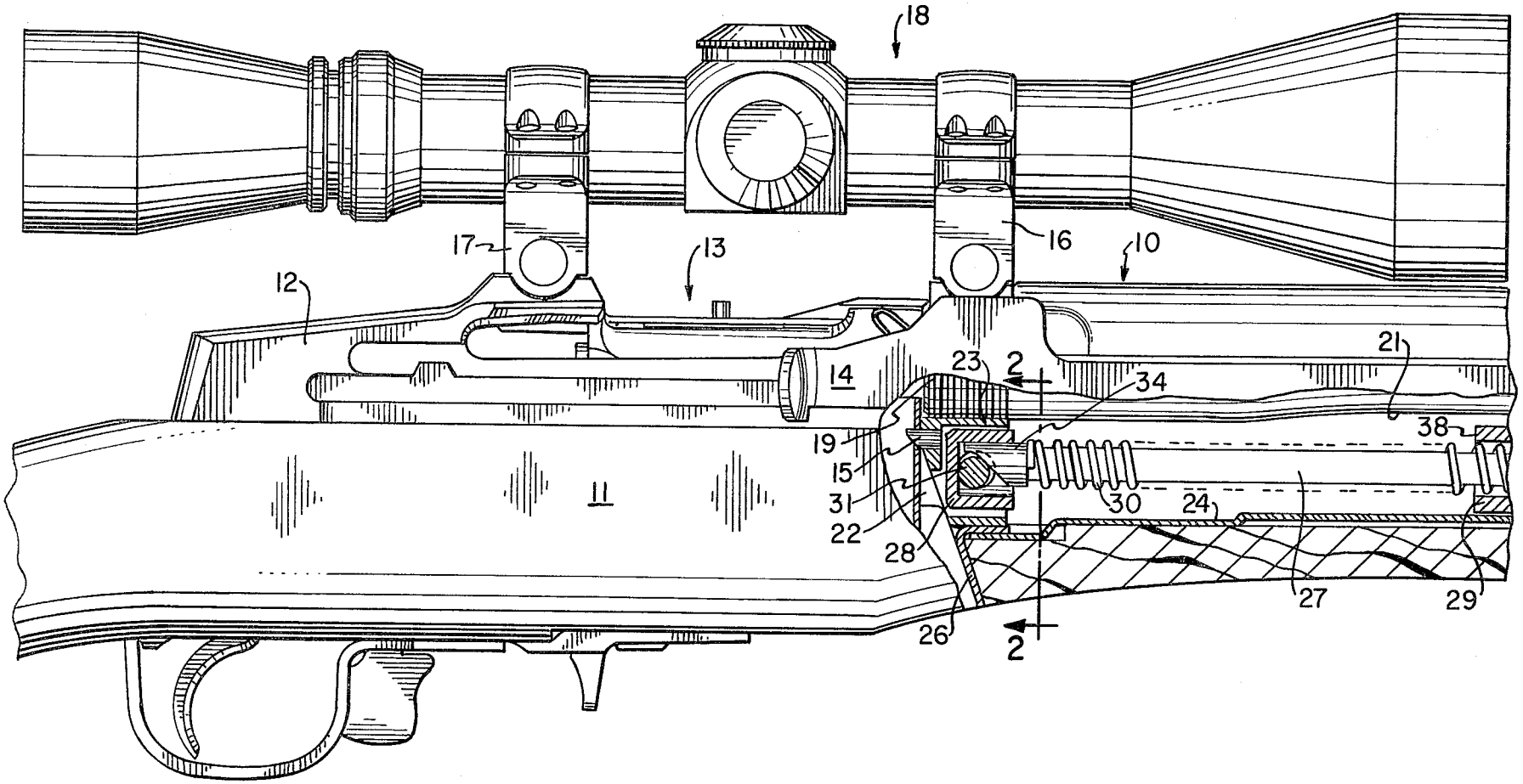
FIG. 1 is a side elevational view partially in section of a portion of a rifle having the present invention.

Referring to FIG. 1, rifle 10 includes stock 11, receiver 12, breech 13, external slide 14, forward scope mount 16, rear scope mount 17 and scope 18. Also shown is breech end of barrel 19, barrel 21, the forward wall 22 of receiver 12, cylindrical receiver extension 23 and internal slide channel 24 secured to bracket 26 at its rearward end. Within slide channel 24, internal slide 29, slide rod 27, floating cylinder socket block 28 and slide return coil spring 30. External slide 14 and internal slide 29 are attached through means not shown so they move together. Also shown in magazine latch 15.

Floating socket block 28 is mounted on stationary axle 31 for limited movement thereon as herein described. Axle 31 is fixed to the vertical walls of receiver extension 23 (see FIG. 2). Since circular openings 32 in the sides of floating socket 28 are slightly larger than the diameter of axle 31 (see FIG. 3), floating socket block 28 is permitted to move up, down, forward and rearward with respect to axle 31. Rod dampening head 34 is slanted to permit coil spring 30 to urged head 34 between axle 31 and the interior wall 33 of the floating socket 28.

Figure 2:
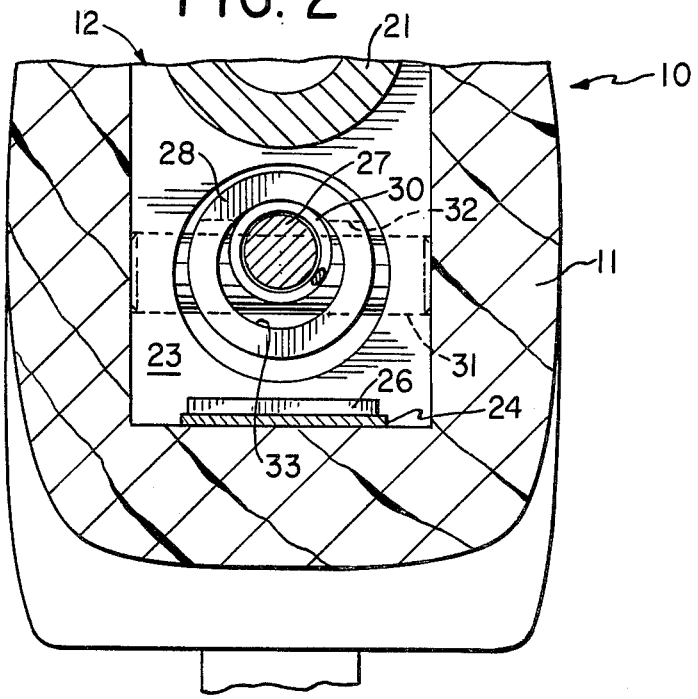
FIG. 2 is an enlarged sectional view along line 2—2 of FIG. 1.
Figure 3:
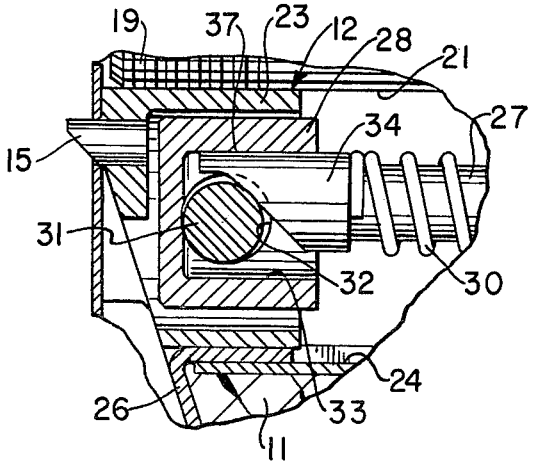
FIG. 3 is a partial enlarged side elevational view of the dampening mechanism when the slide is forward.
Figure 4:
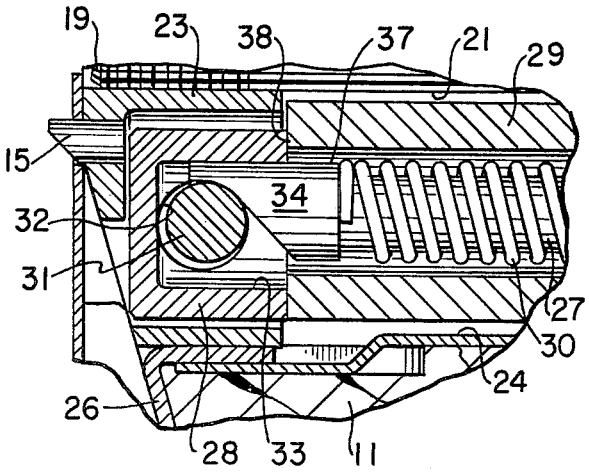
FIG. 4 is a view similar of FIG. 3 with the slide in its rear position.

Turning now to FIGS. 2–4, it is seen that when interior slide 29 is forward, coil spring 30 has sufficient force to orient floating socket 34 as shown in FIG. 3 with the upper surface 37 of dampening head 34 engaging and aligned with the upper interior curved wall 33 of floating socket block 28. In this position socket block 28 is lifted and moved forward so that axle 31 is positioned in the rearward lower portion of circular openings 32.

Upon discharge of the rifle, internal slide 29 moves rapidly rearward under gas pressure until its slide face 38 abuts floating socket block 28. Socket block 28 is then forced rearwardly to the position shown in FIG. 4 whereupon slide face 38 abuts stationary cylinder receiver extension 23 and stops. During this travel of slide 29 from the point when it first engages floating socket 28 until the floating socket 28 engages the axle 31, the momentum of the speeding slide 29 is in part absorbed and dissipated by causing floating socket block 28 to move rearwardly and downwardly. Further, energy is absorbed through the compression of coil spring 30 as slanted dampening rod head 34 moves forward in reaction to the reduction of space between axle 31 and upper area of socket wall 33. That portion of slide energy not absorbed during this dampening action is absorbed as slide face 38 reaches and engages receiver extension 23 to bring slide 29 to a complete stop.

The floating socket 28, axle 31, receiver extension 23, slide rod 27 and rod dampening head 34 are made of steel. No rubber, plastic or other resilient materials are used with the exception of coil spring 30 which is made of spring steel. The use of steel parts avoids the disadvantage of non-steel parts which include ageing and deterioration by solvent action.

I claim:

1. In a firearm having a reciprocating slide positioned forward of the receiver in a slide channel and associated with a rod the improvement comprising (a) the rod having a dampening head attached to its rearward end;

(b) a recessed floating block means positioned in the slide channel forward of the receiver for receiving the rod dampening head;

(c) floating block mounting means for mounting the floating block to permit limited movement of the floating block in the slide chamber;

(d) spring means on the rod urging the rod rearwardly;

(e) cam means on the rod dampening head to engage the mounting means through the urging of the spring means to position the block in a forward position;

(f) face means on the block for engagement with the slide as it moves rearwardly to move the block to a rearward position on its mounting means causing the rod dampening head and attached rod to be moved forwardly to compress the spring means whereby block movement rearwardly, dampening head rod movement forwardly and spring means compression absorb energy from the rearwardly moving slide.

2. The improvement of claim 1 having in addition slide stop means positioned forward of the receiver to stop the slide after the slide has engaged and moved the floating block means.

3. The improvement of claim 1 in which the block mounting means includes a cylindrical axle mounted on the slide guide and oversize circular holes in the sides of floating block means to permit the block means to move limited distances with respect to the mounting means.

4. The improvement of claim 1 in which the recessed floating block means has an interior surface and the rod head has an exterior surface which bears against said interior surface of the block means and against the mounting means such that when the block means is driven rearwardly the rod dampening head is driven in the opposite direction.

* * * * *